US009695623B2

(12) United States Patent
Thomas

(10) Patent No.: US 9,695,623 B2
(45) Date of Patent: Jul. 4, 2017

(54) POWERED FOLDING DOORS

(71) Applicant: Derek Keith Thomas, Hertfordshire (GB)

(72) Inventor: Derek Keith Thomas, Hertfordshire (GB)

( * ) Notice: Subject to any disclaimer, the term of this patent is extended or adjusted under 35 U.S.C. 154(b) by 0 days.

(21) Appl. No.: 14/848,642

(22) Filed: Sep. 9, 2015

(65) Prior Publication Data

US 2017/0067280 A1 Mar. 9, 2017

(51) Int. Cl.

| | |
|---|---|
| ***E05F 15/605*** | (2015.01) |
| ***E05F 15/60*** | (2015.01) |
| ***E05F 15/70*** | (2015.01) |
| ***E06B 3/48*** | (2006.01) |
| ***E05F 3/22*** | (2006.01) |

(52) U.S. Cl.

CPC ..... *E05F 15/60* (2015.01); *E05F 3/224* (2013.01); *E05F 15/605* (2015.01); *E05F 15/70* (2015.01); *E06B 3/481* (2013.01); *E05Y 2900/132* (2013.01); *E05Y 2900/148* (2013.01)

(58) Field of Classification Search

CPC ..... E05F 15/605; E05F 3/224; E06B 3/481

USPC ..... 160/188, 199, 206; 16/50, 68, 289, 290, 16/326

See application file for complete search history.

(56) References Cited

U.S. PATENT DOCUMENTS 2,891,274 A * 6/1959 Bloom ..... E05F 1/1269 16/291
3,116,782 A * 1/1964 Rudnick ..... E05F 1/1066 160/118
3,275,064 A * 9/1966 Hansen ..... E05D 3/022 160/206
3,361,188 A * 1/1968 Rudnick ..... E05F 7/005 160/118
3,385,344 A * 5/1968 Andrews ..... E06B 3/481 16/73
3,811,489 A * 5/1974 Thun ..... E06B 3/481 16/307
3,849,835 A * 11/1974 Jerila ..... E05F 1/1269 16/291
3,907,021 A * 9/1975 Smith ..... E05D 15/26 16/388
4,731,904 A * 3/1988 Sprague ..... E05D 15/264 16/286

(Continued)

*Primary Examiner* — David Purol
(74) *Attorney, Agent, or Firm* — Invention To Patent Services; Alex Hobson

(57) ABSTRACT

A powered folding door or window system includes at least two rigid panels that are linked together by at least one vertical hinge/pivot to fold between a closed state, where the panels extend across an opening, to an open state, where they are retracted to one side of the opening and stacked against each other. The system incorporates a motor and a drive belt mechanism as primary means for driving the panels. The system further includes a powered actuator on one of the panels and a co-operative element on a linked adjoining panel; whereby the powered actuator cooperates with the co-operative element on the linked adjoining panel to move the linked adjoining panel and said one panel about the vertical hinge/pivot linking them; whereby the powered actuator may start the opening of the door or window system and/or complete the closing of the system.

18 Claims, 7 Drawing Sheets

(56) References Cited

U.S. PATENT DOCUMENTS

| | | | | |
|---|---|---|---|---|
| 5,070,926 | A * | 12/1991 | Behring | E05D 15/26 160/199 |
| 6,257,304 | B1 * | 7/2001 | Jacobs | E05D 15/264 160/206 |
| 7,942,185 | B2 * | 5/2011 | Long | E05F 15/627 160/188 |
| 8,096,341 | B2 * | 1/2012 | Teunissen | E05D 15/26 160/199 |

* cited by examiner

POWERED FOLDING DOORS

BACKGROUND OF THE INVENTION

Field of the Invention

The present invention concerns improvements in and relating to powered folding doors and windows, all being folding access closures of openings in walls of buildings.

Background

Powered folding doors and windows to which the present invention relates are most suitably of the bi-fold or tri-fold type having multiple rigid panels (also known as leaves) that fold about vertical hinges' pivots. The panels may be glazed or not and may be of wood, aluminum or any other suitable material or combination of materials. The panels may, for example, have rectangular frames composed of wood or composed of PVC and aluminum extrusions and be inlaid with glazing panes. The doors generally cover relatively wide openings (e.g. spanning openings of from 1.5 m to 3, 4 or 5 m or more wide and that in most cases are about 2 m high) by travelling horizontally. In residential and commercial applications the door's might be 'French doors' or 'patio doors' or may be internal doors or partitions, for example.

In the existing powered bi-fold or tri-fold sliding folding doors the opening and closing of the doors is generally powered by an electric motor, suitably a DC motor. The main opening and closing action of the folding door in the relevant existing powered folding door systems, relies on the electric motor acting via a drive belt to pull the doors open or closed, normally with the door panel upper and/or lower pivot pins sliding along a horizontal guide rail which is commonly positioned along the top of the door opening. Where there are more than two folding door panels/leaves in series, due to the dynamics of these types of door it is generally not possible to fully close or open the door simply by the drive belt pulling on the door stack and it is normal for the user to have to manually apply an extra push to the door to make it complete its travel to the fully opened or closed state. For this reason the existing powered folding door systems are not fully automatic, i.e. are not able to operate at the press of a button or operation of a switch by a control processor or in response to a sensor or any other suitable means to open or to fully close without manual intervention. The present invention seeks to overcome these limitations to allow for full automation of such doors

SUMMARY OF THE INVENTION

According to the present invention there is provided a powered folding door or window system wherein the folding door or window system comprises: at least two rigid panels where the panels are linked together by one or more vertical hinges/pivots to fold between a closed state where the panels extend across an opening to an open state where they are retracted to one side of the opening, stacked against each other, and the system having a motor and a drive belt mechanism for driving the panels to move between the open and closed states, the system further having a powered actuator on one of the panels and a co-operative element on a linked adjoining panel whereby when the powered actuator is powered to move it co-operates with the co-operative element on the linked adjoining panel to move the linked adjoining panel and said one panel together or apart about the one or more vertical hinges/pivots linking them so that the powered actuator starts the opening of the door or window system and/or complete the closing of the door or window system.

In essence the present invention augments the opening and closing belt drive mechanism by providing an effective "motorized hinge" between the folding panels to initiate the folding open action and/or complete the folding closed action, overcoming the need for the user to manually push the panels to initiate the folding open action or complete the folding closed action.

In a door system of more than three folding panels in series there may be a powered actuator and co-operative element arranged between each of the first and second hinged panel pair and the third and fourth hinged panel pair. Similarly for folding door systems of more four linked panels each alternate linked pair of panels may have a corresponding powered actuator and co-operative element between them. Using the system of the present invention a stack/series of as many as ten folding panels can be reliably opened and closed.

The drive belt mechanist may be entirely conventional and suitably comprises a belt, chain or other flexible linkage to pull the panels for driving them in opening and closing directions. This may be powered by an electric motor, for example a DC electric motor.

The powered actuator is preferably powered by an electric motor, for example a DC electric motor and preferably a servo-motor or stepper motor.

In the practical embodiments of the invention, the powered actuator's motor is a dedicated motor and it suitably is housed in the door panel while the electric motor for the belt drive mechanism is housed in a frame that lines the door/window opening. Both the actuator motor and belt drive motor preferably run off of the same power supply, and which may suitably be a 24 v power supply. A common controller is suitably provided to co-ordinate the movement of the actuator and of the drive belt so that each operates in the required sequence and with the required timing. The controller suitably comprises a processor programmed to co-ordinate the movement of the actuator and of the drive belt.

The powered actuator is preferably a linear reciprocating actuator configured to push apart the panels to start the door or window system's movement to the opened state and, when operated in reverse, to pull together the panels to complete the door/window system's movement to the closed state. The powered actuator preferably has the form of a rod. Preferably, the actuator is substantially housed in the plane of the panel, within the panel and projecting out through a vertical edge face of the panel.

The electric motor to power the powered actuator is suitably housed within the panel. In the case of a panel that has an outer frame of horizontal and vertical box section members (e.g. a frame surrounding a glazing unit) the actuator and preferably also the motor are suitably housed in a horizontal box section member (suitably the top horizontal frame member of the panel). The actuator and co-operative element are unobtrusive and substantially concealed from view. When the folding door or window is in the opened state, the actuator having performed its job of extending to initiate opening, the actuator is suitably retracted back into the panel, preferably substantially entirely, or so that it is substantially only the end of the actuator that serves to engage the co-operative element that remains projecting from the vertical edge face of the panel.

One of the actuator and the co-operative element suitably has a hook while the other has a pin or rod to be releasably engaged by the hook. The use of a hook facilitates use of the actuator and the co-operative element not only for initial opening but also for the closing completion movement. In a variant of this the hook might be replaced by an eye that the pin of the actuator drops vertically into before the pulling/pushing action is carried out. Such latter variant does, however, necessitate provision of a raising and lowering mechanism for the actuator and is thus not preferred.

The co-operative element pin or rod is in use oriented substantially vertically and the hook formation is configured to pivot about the pin/pivot pin for part of a turn (normally for up to about 10 to 15° in operation). This pin/pivot pin is not a pivot of the hinged linkage between the linked panels. It is suitably not load-bearing and is spaced from the one or more vertical hinges/pivots linking the panels. The pin/pivot pin may suitably comprise a ring, tube or cylinder of a robust low friction material. It may be of nylon. It preferably is a roller/carried in a way that allows it to roll around its longitudinal axis so that it facilitates reduction of static friction in use. It may be secured to an actuator arm/rod by a nut and bolt securement or other fixing.

Where the one or more vertical hinges/pivots are at a first major face (e.g. front face) of the closed powered folding door or window system, the co-operative element is closer than the one or more vertical hinges/pivots to the second major face/obverse face (e.g. rear face). The co-operative element is within the plane of the door system when the system is in the closed state and is sandwiched between the vertical edge faces of the adjoining panels. Suitably the actuator and co-operative element are each positioned substantially mid-way between the first major face and second major face/obverse face of the closed folding window/door.

The actuator preferably has the hook as a hook formation at one end of the actuator to engage the co-operative element on the linked adjoining panel.

The powered folding door or window system of the present invention may be fully automated having a control switch whereby on activation of the control switch the folding door or window may open itself or fully close itself without any user intervention.

The summary of the invention is provided as a general introduction to some of the embodiments of the invention, and is not intended to be limiting. Additional example embodiments including variations and alternative configurations of the invention are provided herein.

BRIEF DESCRIPTION OF THE DRAWINGS

The accompanying drawings are included to provide a further understanding of the invention and are incorporated in and constitute a part of this specification, illustrate embodiments of the invention, and together with the description serve to explain the principles of the invention.

DETAILED DESCRIPTION OF THE ILLUSTRATED EMBODIMENTS

Figure 1:
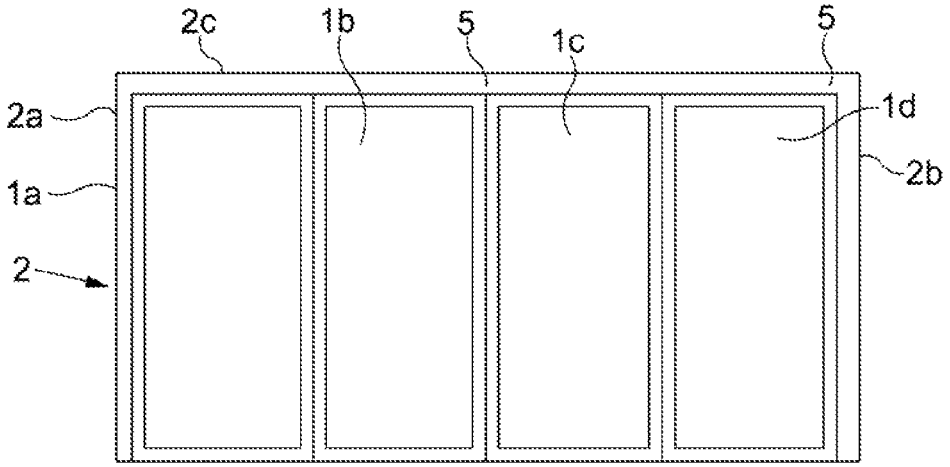
Figure 2:
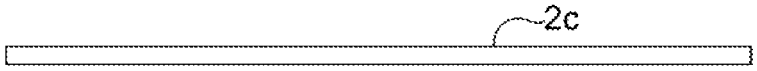
Figure 3:
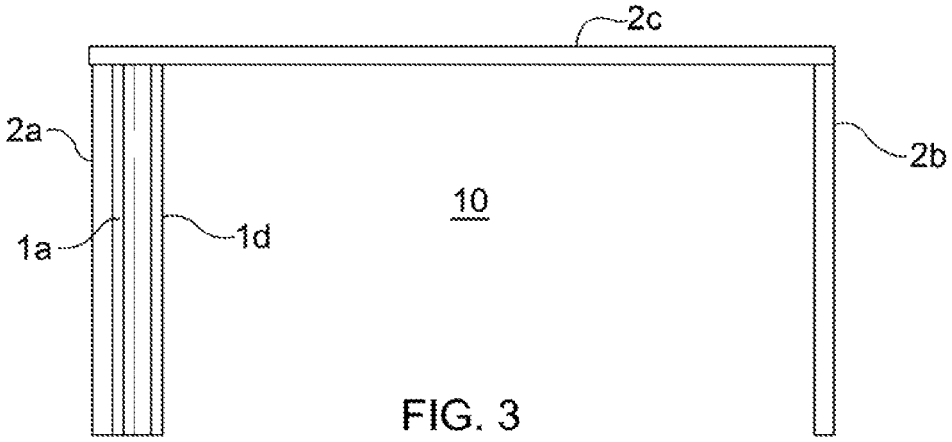
Figure 4:
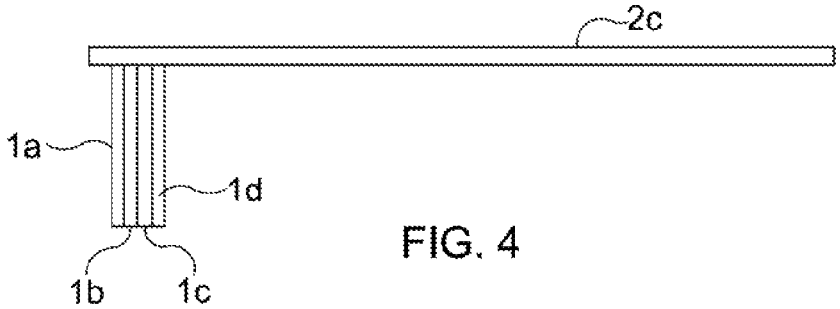
Figure 5:
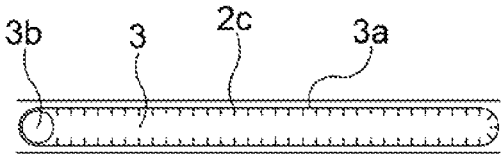
Figure 6:
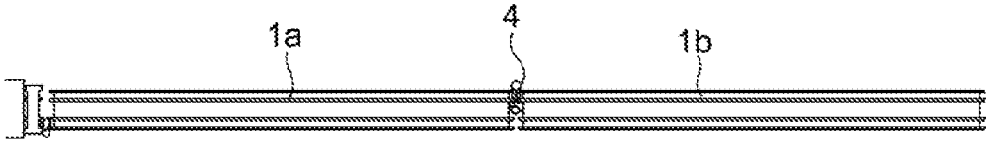
Figure 7:
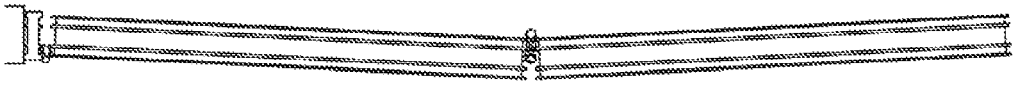
Figure 8:
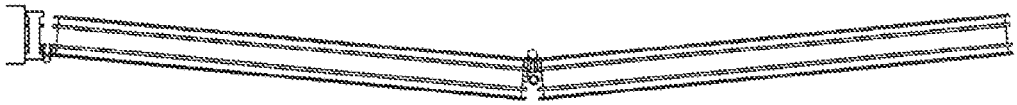
Figure 9:
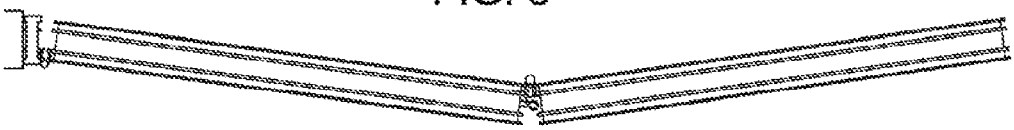
Figure 10:
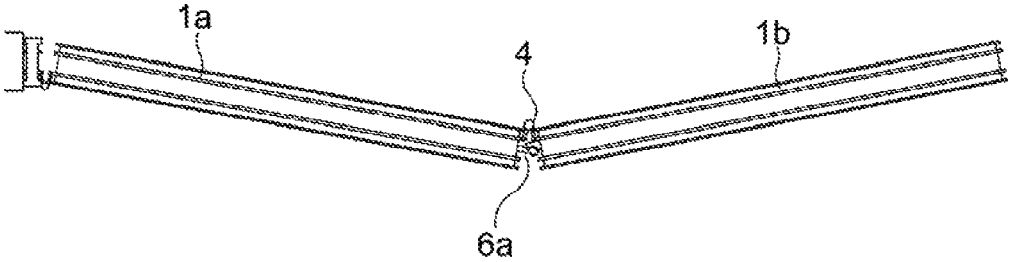
Figure 11:
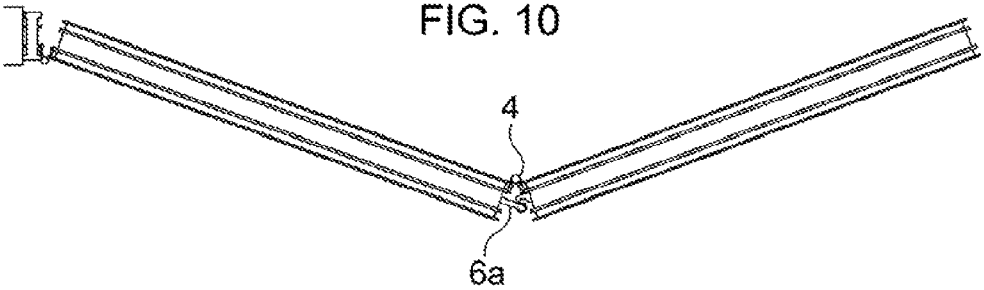
Figure 12:
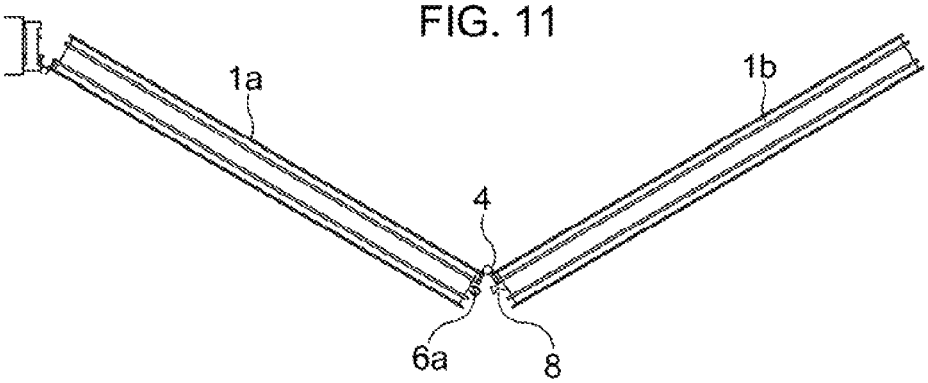
Figure 13:
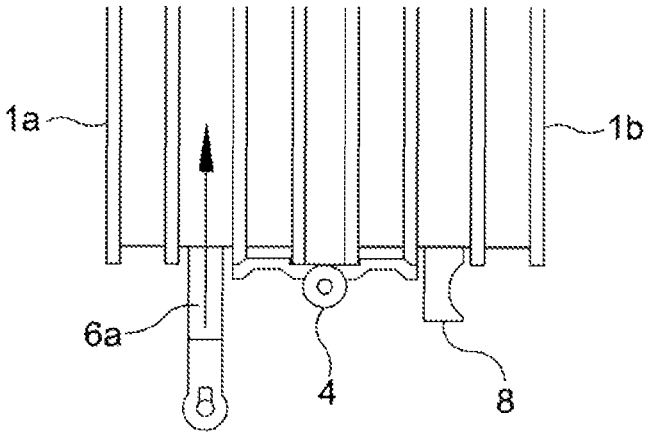
Figure 14:
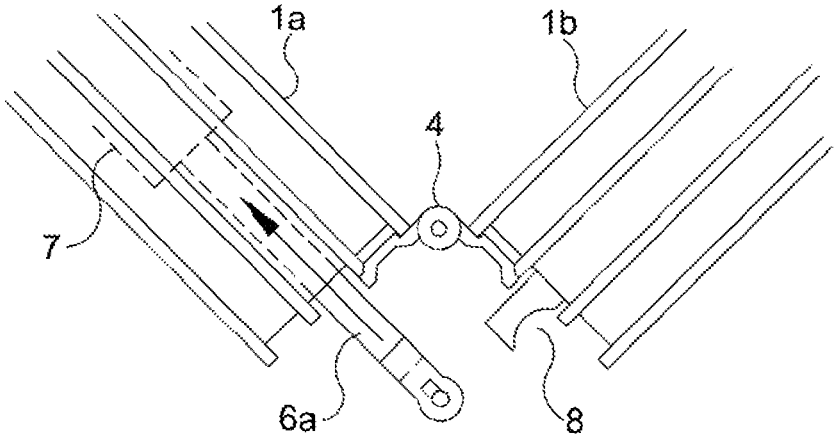
Figure 15:
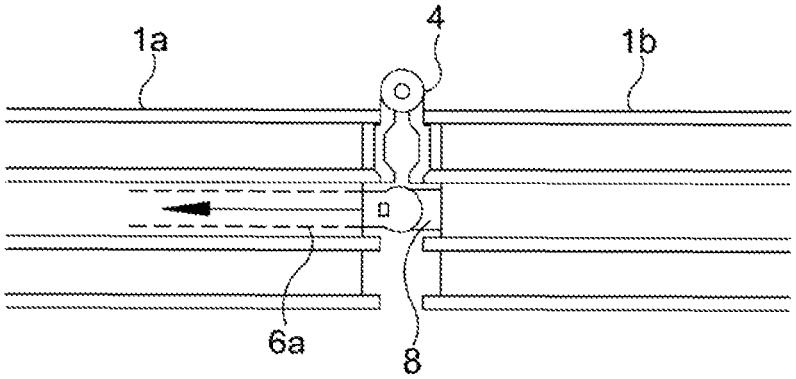
Figure 16:
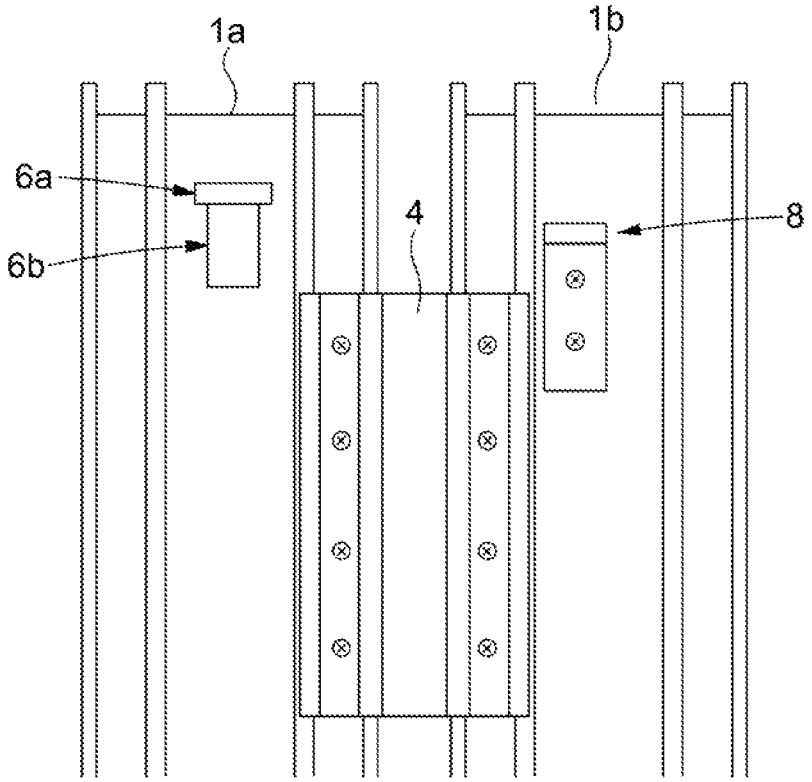

A preferred embodiment of the present invention comprising sliding folding French doors will now be more particularly described by way of example with reference to the accompanying drawings, wherein:

FIGS. 1 and 2 are, respectively, a front elevation view and a top plan view of the French doors in the closed state;

FIGS. 3 and 4 are, respectively, a front elevation view and a top plan view of the French doors in the opened state with the panels stacked neatly to one side of the opening;

FIG. 5 is a schematic plan view from below of the guide rail for the sliding folding doors, showing the substantially conventional belt drive mechanism;

FIGS. 6 to 12 are plan views from above of two adjoining panels of the sliding folding doors, the successive figures showing the successive stages of the folding doors as they move from fully closed to part open (at 0° open, 2.5° open, 5° open, 7.5° open, and 10° open respectively);

FIGS. 13 to 15 are close-ups of the plan views of the two adjoining panels where they join, showing the upper door hinge that links them and showing the actuator on one of the panels and the co-operating element on the other of the panels that initiate the opening and complete the closing of the doors, with FIG. 13 being in the closed state, FIG. 14 being transitional to the closed state and FIG. 15 being in the open state with the panels stacked against each other;

FIG. 16 is a front elevation view corresponding to FIG. 13 and

Figure 17:
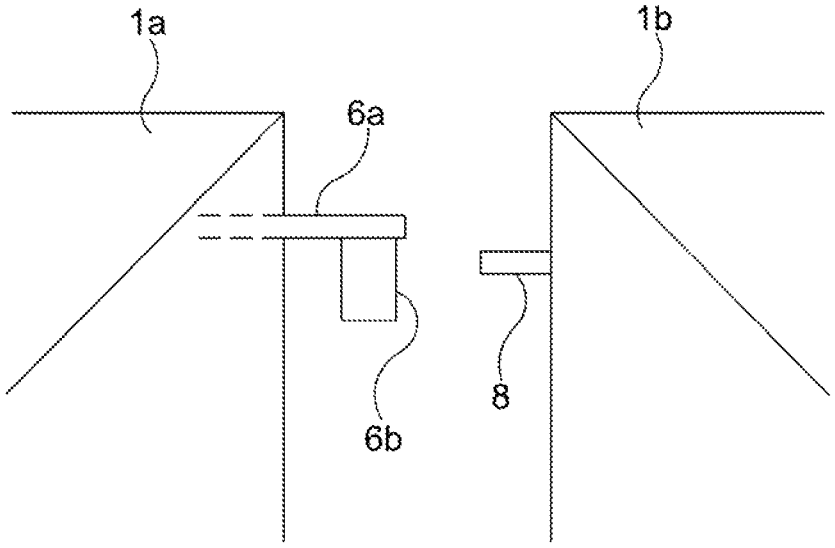
Figure 18:
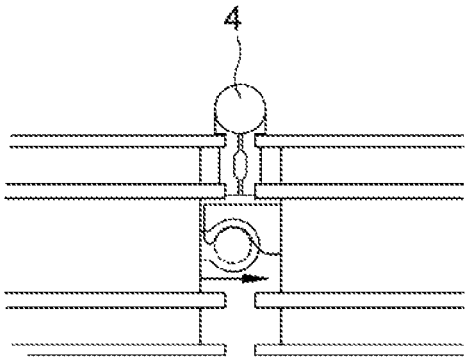
Figure 19:
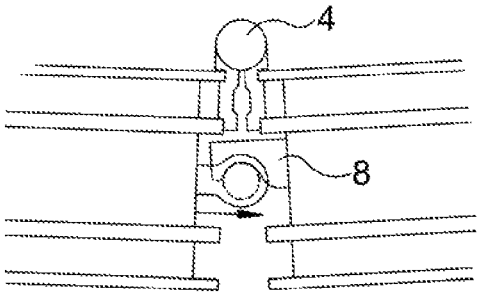
Figure 20:
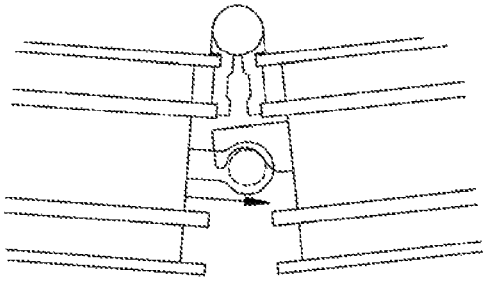
Figure 21:
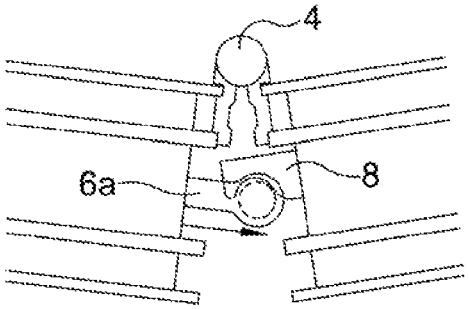
Figure 22:
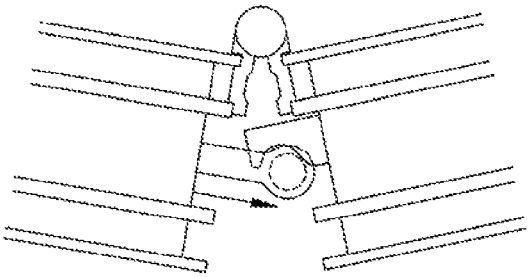
Figure 23:
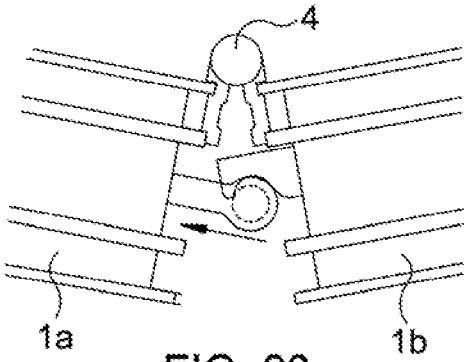
Figure 24:
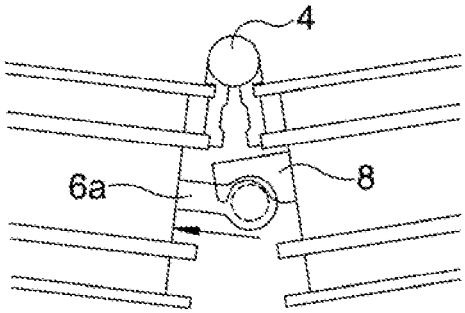
Figure 25:
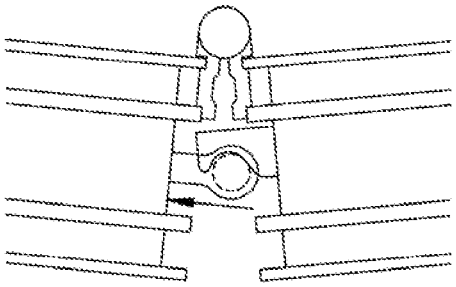
Figure 26:
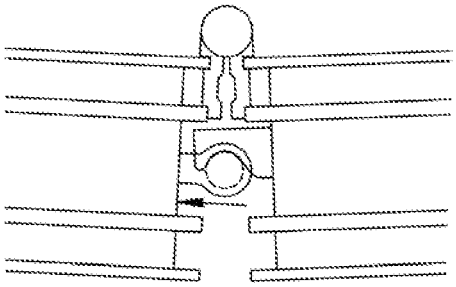
Figure 27:
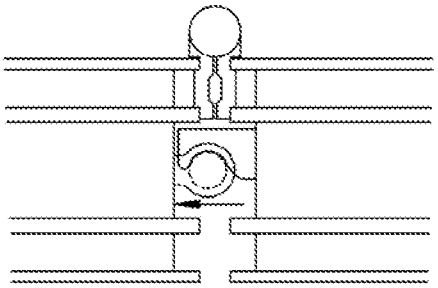
Figure 28:
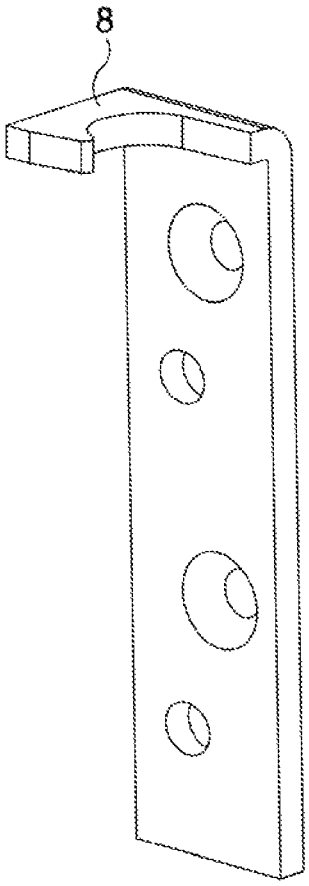
Figure 29:
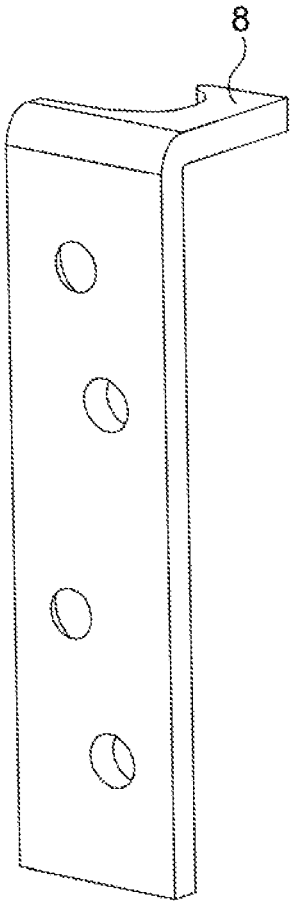
Figure 30:
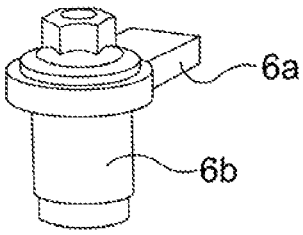

FIG. 17 is an elevation view similar to FIG. 16 but with the adjoining panels in a transitional position;

FIGS. 18 to 22 are close-ups of the plan views of the two adjoining panels where they join, and are similar to FIGS. 13 to 15 but show the incremental initial stages of opening of the door at the join (at fully closed, 2.5° open, 5° open, 7.5° open, and 10° open respectively);

FIGS. 23 to 27 are close-up views similar to FIGS. 18 to 22 but show the incremental completion stages of closing of the door at the join (at 10° from closed, 7.5° from closed, 5° from closed, 2.5° from closed, and fully closed respectively);

FIGS. 28 and 29 are detail views of the hook of the actuator in the form of a bracket; and FIG. 30 is a detail view of a preferred form of the co-operative element that co-operates with the hook.

Corresponding reference characters indicate corresponding parts throughout the several views of the figures. The figures represent an illustration of some of the embodiments of the present invention and are not to be construed as limiting the scope of the invention in any manner. Further, the figures are not necessarily to scale, some features may be exaggerated to show details of particular components. Therefore, specific structural and functional details disclosed herein are not to be interpreted as limiting, but merely as a representative basis for teaching one skilled in the art to variously employ the present invention.

Certain exemplary embodiments of the present invention are described herein and are illustrated in the accompanying figures. The embodiments described are only for purposes of illustrating the present invention and should not be interpreted as limiting the scope of the invention. Other embodiments of the invention, and certain modifications, combinations and improvements of the described embodiments, will occur to those skilled in the art and all such alternate embodiments, combinations, modifications, improvements are within the scope of the present invention.

In the illustrated embodiment of the invention as illustrated in FIGS. 1 to 17 the French doors have four glazed panels, or leaves, 1*a-d* that are hingedly linked in series and framed within a threshold frame 2 that lines the doorway opening 10 in the building. The threshold frame 2 hereshown has a respective one of a pair of upright members 2*a*, 2*b* at each end of the opening 10 and a horizontal top member 2*c* running along the top of the opening 10. Each glazed panel/leaf 1*a-d* has a rectangular frame of wood or PVC and aluminium extrusions and inlaid with a double glazing unit. The horizontal and vertical frame members of each pane/leaf 1*a-d* are suitably of box section, having a hollow interior.

The horizontal top member 2*c* of the thresh-hold frame 2 has a downwards facing channel along its length and serves as a guide rail to guide the panels 1*a-d* between opened and closed states. The thresh-hold frame's horizontal top member 2*c* accommodates a belt drive mechanism 3 (comprising a toothed belt 3*a* along its length and a DC electric drive motor 3*b* at one end) as the primary drive for pulling the panels 1*a-d* between the opened and closed states. Although not shown in the drawings, the system may further have a corresponding bottom guide rail too.

The panels 1*a-d* are hinged in series by each adjacent/adjoining pair of panels having a conventional pair of upper and lower door hinges 4 between them near the front of the panels. The upper hinges are close to the top edge of the door and the pivot pin of alternate ones of the upper hinges 4 is extended upwardly 5 to couple with the drive belt 3*a* so as to be dragged along the guide rail in the opening or closing directions by the motion of the belt 3*a*.

The first panel 1*a* of the door is hinged to the left-hand upright 2*a* of the door thresh-hold frame 2 and anchors that end of the series of panels 1*a-d*. The first panel 1*a* simply pivots on the spot but its upper hinge 4 does not slide along the top member/guide rail 2*c*, while the hinges 4 of the successive panels 1*b-d* are able to move. The hinge 4 between the first panel 1*a* of the door and the second panel 1*b* of the door is not coupled to the drive belt 3*a* and is free move away from the plane of the opening 10/door frame 2 as the first panel 1*a* of the door and the second panel 1*b* of the door fold together to stack against the left-hand upright 2*a* of the door thresh-hold frame 2. The same is true of the hinge 4 between the third panel 1*a* of the door and the fourth panel 1*b*.

The hinge 4 between the second panel 1*b* and the third panel 1*c* is coupled 5 to the drive belt 3*a*, as is the hinge 4 at the right hand end of the fourth panel 1*d*. Between the first 1*a* and second 1*b* adjoining panels and between the third 1*c* and fourth 1*d* adjoining panels the hinge 4 (that is free to move away from the plane of the opening 10) is augmented by a 'motorized hinge'. As noted earlier, the drive belt mechanism 3*a*, 3*b* for opening and closing the sliding folding doors is substantially conventional and it is incapable of initiating the opening or completing the closing without user intervention, for example by pushing or pulling on the end panel 2*d*. To free the system from the need for manual intervention and allow it to become fully automated, the system of the present invention is provided with a unique set of 'motorized hinges'.

The 'motorized hinge' is not a door hinge in the conventional sense, it is not like the hinges 4, but rather it is a transient semi-pivotal linkage between the first and second adjoining panels 1*a*, 1*b* and between the third and fourth panels 1*c*, 1*d*. This linkage is powered to push the adjoining/substantially abutting edge faces of these door panels apart folding through several degrees (e.g. 10 degrees) about the hinge 4 to initiate opening or to pull them fully back together the last few degrees to complete closure. As illustrated in FIGS. 5A to 5C and FIGS. 6 and 7, the transient semi-pivotal linkage is provided between each of the two adjoining panels 1*a*, 1*b* or 1*c*, 1*d* just above the upper door hinge 4 that links the pair of panels and slightly rearwards of the hinge 4, close to the mid-section of the panels.

The transient semi-pivotal linkage comprises on one side a DC electric motor 7-powered linear reciprocating actuator 6 housed in the right hand side of the first panel 1*a* (and this arrangement is repeated in the third panel 1*c*). The other side of the transient pivotal linkage comprises a co-operating element 8 on the left side edge of the adjoining panel 1*b* (and this is repeated in the left side edge of the fourth panel 1*d*). The DC electric motor 7 is wholly housed within the box-section upper horizontal frame member of the panel and the actuator 6 is substantially wholly housed therewithin too, but with the free end/distal end of the actuator rod 6*a* protruding out of the panel edge face. The extent to which the actuator rod 6*a* projects from the panel edge face is adjusted by the operation of the motor 7 during the initial door-opening and final door closing procedures.

The free end/distal end of the actuator rod/arm 6*a* carries a circular cylindrical column/pin 6*b* that is oriented vertically, and which serves as the pivot pin part of the transient semi-pivotal linkage. As shown in FIG. 30, the pin/pivot pin 6*b* is embodied as a ring, tube or cylinder of a robust low friction material and configured as a roller, i.e. being carried in a way that allows it to roll around its longitudinal axis, so that it facilitates reduction of static friction in use allowing the system to more readily initiate door opening or closing. The pin/pivot pin 6*b* may be secured to the actuator arm/rod 6*b* by a nut and bolt securement as illustrated in FIG. 30.

The co-operating element 8 on the left side edge of the adjoining panel 1*b* is formed as a shallow hook that can catch onto/engage with the cylindrical column/pin 6*b* and pivot around it through approximately 10° to 15°. Both the actuator rod or its pin 6*b* and the hook 8 are preferably moulded of a robust low friction and highly wear resistant material or appropriately coated to be low friction and highly wear resistant. They can both be moulded of a plastics such as nylon.

The manner and sequence of operation of the transient semi-pivotal linkage for initiating door opening is illustrated in FIGS. 18 to 22; and for completing door closing is illustrated in FIGS. 23 to 27.

The method of driving the powered folding door or window system to close as shown in FIGS. 18 to 22 suitably follows the steps of:

i) the doors are dragged to the "nearly closed position" (approximately 15 degrees) by the belt drive mechanism 3;

ii) each powered actuator 6 is extended and it is then progressively retracted and catches on the hook 8 that is in a fixed position on the meeting door leaf 1*b*, 1*d;* iii) as each actuator 6 continues to be retracted the hook 8 is pulled by the pivot pin 6*b* of the actuator 6 and this forces the hook 8 and rigidly associated leaf to pivot around the pivot pin 6*b* by several degrees causing the door leaves to flatten towards the plane of the door opening 10/threshold frame 2; and iv) the powered actuator 6 pulls on the hook 6 until the first and third door leaf and their adjoining/meeting door leaf 1*b*, 1*d* are substantially in the same plane (0°), i.e. the plane of the door opening 10/threshold frame 2, with the adjoining door leaf vertical edge faces facing and substantially abutting each other.

The method of driving the powered folding door or window system to open as shown in FIGS. 23 to 27 is substantially the reverse of the above:

i) the actuator 6 is powered by its motor to extend;

ii) the pivot pin 6*b* of the actuator 6 thus pushes against the back of the inside of the hook 8 and this causes the hook 8 to pivot about the pivot pin 6*b* of the actuator 6 and with the hook 8 its rigidly-connected leaf turns too so that it opens the door from zero to approximately 15 degrees; and iii) The belt drive mechanism 3 then drags the doors 1*a-d* open to stack neatly at one end of the opening 10 and each actuator 6 is retracted to be unobtrusive.

It will be apparent to those skilled in the art that various modifications, combinations and variations can be made in the present invention without departing from the spirit or scope of the invention. Specific embodiments, features and elements described herein may be modified, and/or combined in any suitable manner. Thus, it is intended that the present invention cover the modifications, combinations and variations of this invention provided they come within the scope of the appended claims and their equivalents.

What is claimed is:

1. A powered folding door or window system comprising:

at least two rigid panels;

wherein the at least two rigid panels are linked together by at least one vertical hinge or pivot to fold between a closed state, where the panels extend across an opening, to an open state, where they are retracted to one side of the opening and stacked against each other;

a primary drive comprising a motor; and a drive belt linked to the at least two panels for driving the at least two panels to move substantially fully between the open and closed states, and a secondary drive comprising a powered actuator on a first panel of the at least two rigid panels and a co-operative element on a linked adjoining second panel of the at least two rigid panels the powered actuator of the second drive being powered to move reversibly extending from the first panel and releasably engaging and it cooperating with the co-operative element on the linked adjoining second panel to move the linked adjoining second panel and said first panel about the vertical hinge or pivot linking them so that the powered actuator starts the opening of the door or window system and or completes the closing of the door or window system.

2. The powered folding door or window system as claimed in claim 1, wherein the powered actuator is powered by an electric motor.

3. The powered folding door or window system as claimed in claim 1, comprising said two linked rigid panels and a further linked rigid panel and there is a respective powered actuator and co-operative element arranged between, one of said two linked panels and the further rigid panel.

4. The powered folding door or window system as claimed in claim 2, wherein the motor is an electric motor that powers the actuator and is housed in the panel with the actuator.

5. The powered folding door or window system as claimed in claim 1, wherein the door or window system is installed in a door or window opening and the primary drive's motor is housed in a frame that lines the opening.

6. The powered folding door or window system as claimed in claim 1, wherein the powered actuator is a linear reciprocating actuator.

7. The powered folding door or window system as claimed in claim 1, wherein the powered actuator is substantially housed in one of the at least two rigid panels, within said panel and an end thereof projecting out through a vertical edge face of said panel.

8. The powered folding door or window system as claimed in claim 7, wherein the second drive's motor to power the powered actuator is housed within the panel within which the powered actuator is substantially housed.

9. The powered folding door or window system as claimed in claim 1, wherein the powered actuator engages and co-operates with the co-operative engagement feature to push apart the panels to start the door or window system's movement to the opened state and is operated in reverse, to pull together the panels to complete the door or window system's movement to the closed state.

10. The powered folding door or window system as claimed in claim 1, wherein one of the actuator and the co-operative element has a hook while the other has a pin or rod to be releasably engaged by the hook.

11. The powered folding door or window system as claimed in claim 10 wherein the hook is of shape, extent and position that it pivots about the pin or rod for part of a turn that is up to no more than 20° in operation.

12. The powered folding door or window system as claimed in claim 10, wherein the actuator has the hook on one end of the actuator to engage the co-operative element on the linked adjoining second panel.

13. The powered folding door or window system as claimed in claim 1, wherein one of the actuator and the co-operative element has an annular eye while the other has a pin or rod to be releasably engaged by the eye.

14. The powered folding door or window system as claimed in claim 13, wherein the annular eye is of shape, extent and position that it pivots about the pin or rod for part of a turn that is up to no more than 20° in operation.

15. The powered folding door or window system as claimed in claim 1, wherein the actuator and co-operative element are each positioned substantially mid-way between a first major face and a second major face of the at least two rigid panels in a closed state, the second major face being obverse to the first major face.

16. The powered folding door or window system as claimed in claim 1, wherein the folding door or window system comprises at least said at least two rigid panels and a further rigid panel in a series.

17. The powered folding door or window system as claimed in claim 1, wherein the folding door or window system comprises said at least two rigid panels and a further two rigid panels in a series.

18. The powered folding door or window system as claimed in claim 1, wherein one of the actuator and the co-operative element comprises:

a pin or pivot pin that comprises a ring, tube or cylinder that is a roller, wherein the roller rolls around a longitudinal.

* * * * *